US005701840A

United States Patent [19]

Cross

[11] Patent Number: 5,701,840

[45] Date of Patent: Dec. 30, 1997

[54] PIVOTALLY MOUNTED BANNER HARNESS

[76] Inventor: Richard D. Cross, 5220 Lardon Rd. NE., Salem, Oreg. 97305

[21] Appl. No.: 675,852

[22] Filed: Jul. 3, 1996

[51] Int. Cl.[6] ..... G09F 17/00

[52] U.S. Cl. ..... 116/174; 116/173; 40/607

[58] Field of Search ..... 116/173–175; 40/603, 604, 607, 617; 73/170.01, 170.05, 170.06, 170.07, 861.74, 861.75

[56] References Cited

U.S. PATENT DOCUMENTS

| | | | |
|---|---|---|---|
| 1,254,524 | 1/1918 | Mink | 116/173 |
| 1,306,915 | 6/1919 | Klamroth | 116/174 |
| 1,355,861 | 10/1920 | Spaulding | 116/173 |
| 2,869,507 | 1/1959 | Boyer | 116/173 |
| 3,395,577 | 8/1968 | Keim | 73/170.05 |
| 4,227,406 | 10/1980 | Coffey | 73/170.05 |
| 5,016,373 | 5/1991 | Theno | 40/617 |

FOREIGN PATENT DOCUMENTS

| | | | |
|---|---|---|---|
| 69979 | 8/1914 | Austria | 40/617 |

*Primary Examiner*—William A. Cuchlinski, Jr.
*Assistant Examiner*—Andrew Hirshfeld
*Attorney, Agent, or Firm*—Bush, Riddle & Jackson

[57] ABSTRACT

A harness assembly that mounts a banner or flag on a pole in a manner that allows alignment with the wind while promoting a dancing or waving action, includes a triangular plate pivoted to the pole and tied by a pair of flexible cords to a transverse rod at the inner end of the banner.

5 Claims, 1 Drawing Sheet

FIG. 1
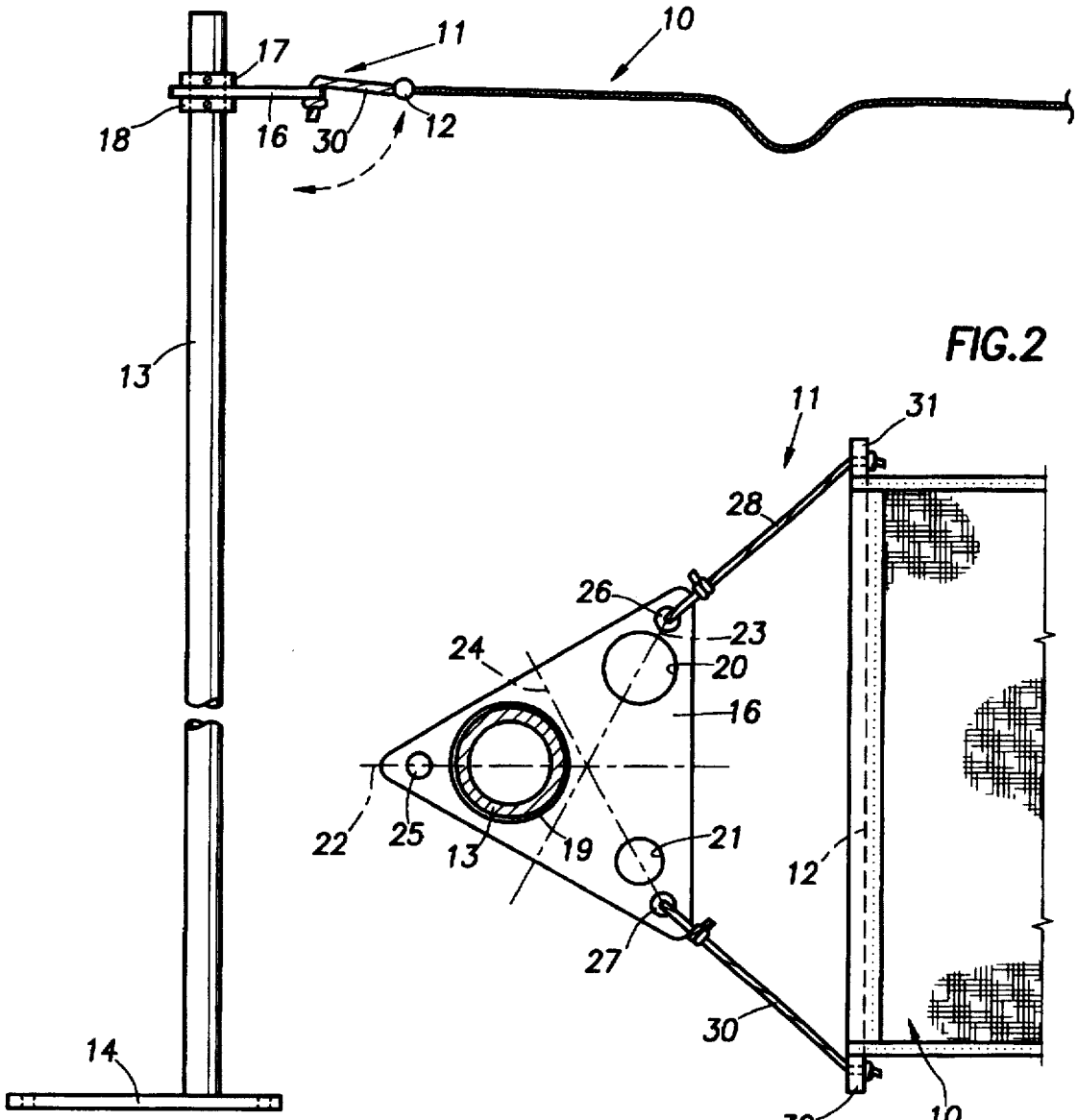
FIG. 2
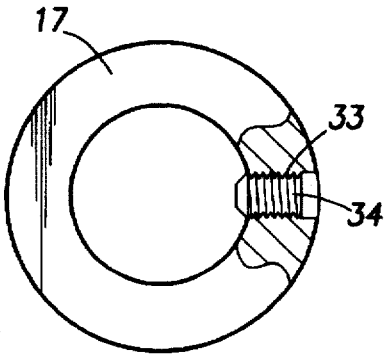
FIG. 3

PIVOTALLY MOUNTED BANNER HARNESS

FIELD OF THE INVENTION

This invention relates generally to a harness that ties a banner (or flag) to a pole to allow the banner to fly in the wind, and particularly to a harness of the type described that allows the banner to align itself with changes in wind direction while restraining diving in a manner that produces a fluttering or dancing action of the banner.

BACKGROUND OF THE INVENTION

A banner or a flag commonly is attached in an upright position to a pole or staff at spaced points on its inner edge. The wind causes the flag or banner to fly upright and display whatever distinctive symbol, design or legend that may be on them. Changes in wind speed and localized turbulences in air flow causes waves to appear and travel along the banner fabric. Common shapes are square, rectangular and triangular. When the direction of the wind changes, the banner will attempt to align itself with that direction, and various devices are known to permit swivel motion of the attachment so that the banner does not furl around the pole and tangle.

The present invention relates to an elongated banner or flag that is flown generally horizontally to attract attention. This type of device is lifted by the wind much like a kite, and its inner end which is next to the pole is subject to diving in response to changes in wind speed and/or direction. Applicant has discovered a unique harness for attaching such inner end to the pole in a manner such that this diving tendency is employed to make the action of the banner in the wind even more attractive of attention by causing the banner to undergo dancing or rolling undulations, while remaining aligned with the wind direction as the banner flies.

The general object of the present invention is to provide a new and improved harness assembly for attaching a banner or flag to a support pole in a manner that allows alignment with changing wind directions while inducing traveling wave motions in the fabric.

SUMMARY OF THE INVENTION

The above and other objects are attained in accordance with the present invention through the provision of a harness assembly to secure the inner end of a banner or flag to a pole, including a swivel plate that has a hole therein through which the pole extends so that the plate can rotate on the pole. The plate is held in a fixed longitudinal position by upper and lower stop rings. A pair of spaced-apart and smaller attachment holes are provided in the plate outwardly of the hole but at the same radial distance therefrom so that the centers of the three holes define the corners of an equilateral triangle. A rod is positioned at the inner edge of the banner, and equal length flexible cords attach the opposite ends of the rod to respective attachment holes in the plate. When the wind direction changes, forces transmitted by the harness cause the plate to pivot on the pole until alignment with the new direction is achieved. Even small variations in wind speed, or changes in wind direction, reduce rift and cause the inner edge of the banner to tend to dive. However the cords limit such diving motion, and when the wind's velocity and lift increase, the inner edge rises suddenly and induces a rolling wave in the banner fabric which travels outward. Such movements provide a very pleasing dancing effect to the banner.

BRIEF DESCRIPTION OF THE DRAWINGS

The present invention has the above as well as other objects, features and advantages which will become more clearly apparent in connection with the following detailed description of a preferred embodiment, taken in conjunction with the appended drawings in which:

FIG. 1 is a schematic view of a banner harnessed to a pole in accordance with the invention;

FIG. 2 is an enlarged top view of the harness assembly of FIG. 1; and

FIG. 3 is a top view of a guide ring.

DETAILED DESCRIPTION OF A PREFERRED EMBODIMENT

Referring initially to FIG. 1, an elongated banner or flag 10, which flies generally in the horizontal, has a small diameter support rod 12 extending through a hem or the like at its inner end. The banner 10 typically is a long narrow device about 1 foot wide and up to 15 to 20 feet long. The rod 12 is coupled near the upper end of a support pole 13 by a harness indicated generally at 11 so that the banner can fly from the pole. A base plate 14 can be employed at the lower end of the pole 13 to fix it in an upright position to a surface such as the ground or on a building, a fence, or any other structure that is out in the wind. Of course the pole 13 could be mounted on a moving vehicle of some sort so that wind currents are created in part by movement of the vehicle through the air. The pole 13 typically will be a metal tube having a diameter from about ¾ inch to 1⅜ inches.

As shown in FIG. 2, harness assembly 11 includes a swivel plate 16, preferably but not necessarily in the shape of an equilateral triangle that pivots on the pole 13 between upper and lower guide rings 17, 18. The rings 17, 18 are fixed to the pole by set screws or the like. The plate 16, which preferably is made of a plastic material such as a polycarbonate having a thickness of about 3/16 inch, has sides which are each about 6 inches long. The plate 16 has formed therethrough three different sizes of large diameter holes 19–21 centered on respective major chords 22–24 of the triangle, such holes being sized to accommodate different sizes of poles 13 upon which the plate may be mounted. In addition, smaller holes 25–27 are formed near the respective corners of the plate 16 for tying small cords or ropes thereto, and the corner edges of the plate preferably are rounded off, as shown, for safety purposes.

A pair of small diameter, flexible harness cords or ropes 28, 30 are tied between respective holes 26, 27 and the opposite end portions 31, 32 of the rod 12 which may have small holes drilled therethrough for tieing purposes. The cords 28, 30 are of equal length so that the rod 12 is tied parallel to a line through the attachment holes 26, 27. The pole 13 extends through, for example, the large hole 19 in the plate 16 so that the plate is mounted for pivotal rotation in a plane that is at a right angle to the longitudinal axis of the pole. There is ample clearance for free pivotal movement of the plate 16 between the stop rings 17, 18.

As shown in FIG. 3 each of the stop rings 17, 18 has a radial threaded bore 33 that receives a set screw 34 that can be tightened by a suitable tool against the pole 13 in a selected elevation thereon.

OPERATION

In operation and use of the present invention, the harness plate 16 is positioned on the pole 13 with the stop rings 17, 18 respectively above and below it, the pole passing through a selected one of holes 19–21 having a slightly larger diameter than the pole so that the plate can pivot freely thereon. The guide discs 17, 18 are spaced to provide ample clearance, and then the set screws 34 are tightened. The inner ends of the flexible cords 28, 30 are tied off to that pair of holes which are on the opposite side from the mounting hole being used, and the outer ends of the cords are secured to the respective outer end portions 31, 32 of the rod 12 in a manner such that the tensioned lengths of the cords are equal, or substantially so. With no wind, the banner 10 would hang downward and be supported from the outer edge of the plate 16 by the cords 28, 30.

Under sufficient wind force, the banner 10 flies directly outward from the plate 16 with the cords 28, 30 and the rod 12 lying in the same plane as the plate. In response to a change in only the direction of the wind, the cords 28, 30 pull the pivot plate 16 around somewhat on the pole 13 until the new alignment is attained. In response to even a slight and momentary drop in wind velocity, the inner end portion of the banner 10 and the rod 12 will tend to dive as lift forces are reduced. A small mount of diving motion is permitted on account of the length and flexibility of the cords 28, 30.

When wind velocity increases, the lift is regained and the rod 12 moves upward into the plane of the swivel plate 16. Such movement imparts an undulation, wave or roll in the banner fabric which travels outward to provide an attractive and pleasing action. In response to turbulences in the wind, slight transverse or rocking motions of the inner end of the banner can be produced, which also provide a dancing effect. Indeed the flexibility of the cords 28, 30 allows some oscillating motions to occasionally occur.

It now will be recognized that a new and improved banner or flag harness assembly has been provided. Since certain changes and modifications may be made in the disclosed embodiment without departing from the inventive concepts involved, it is the aim of the appended claims to cover all such changes and modifications falling within the true spirit and scope of the present invention.

What is claimed is:

1. An assembly including a harness and a vertically oriented pole, said harness for securing the inner end of a banner or flag to said pole and comprising: plate means having a first hole by which said plate means is pivotally mounted around said pole, rod means adapted to be secured to said inner end of said banner or flag; and flexible cords attaching the end portions of said rod means to laterally spaced points on said plate means with said points being equidistant from said hole and on a line that is substantially parallel to said rod means.

2. The assembly of claim 1 where the centers of said hole and said laterally space points define the corners of an equilateral triangle, and wherein said flexible cords have substantially the same length.

3. The assembly of claim 2 wherein said plate means has at least one additional mounting hole of a different diameter from said first hole to accommodate swivel mounting of said plate means on at least one different size pole, there being an additional set of attachment points on said plate means for said cords when said additional mounting hole is mounted on said different size pole.

4. The assembly of claim 2 where said first hole is centered on a line that extends from a corner of said plate means adjacent thereto to the midpoint of the side of said triangle that is opposite said first hole.

5. The assembly of claim 1 further including upper and lower stop means for maintaining said plate means at a selected vertical location of said pole.

* * * * *